US011049368B2

(12) United States Patent
Bolling, Jr. et al.

(10) Patent No.: US 11,049,368 B2
(45) Date of Patent: Jun. 29, 2021

(54) SKILL-BASED GAMING MACHINE AND METHOD THAT MAINTAIN A DESIRED RETURN TO PLAYER

(71) Applicant: Aristocrat Technologies Australia Pty Limited, North Ryde (AU)

(72) Inventors: T. Grant Bolling, Jr., Maryland Heights, MO (US); Kurt Larsen, Las Vegas, NV (US); C'era Oliveira, Las Vegas, NV (US); Joseph Masinter, Las Vegas, NV (US)

(73) Assignee: ARISTOCRAT TECHNOLOGIES AUSTRALIA PTY LIMITED

( * ) Notice: Subject to any disclaimer, the term of this patent is extended or adjusted under 35 U.S.C. 154(b) by 0 days.

(21) Appl. No.: 16/521,797

(22) Filed: Jul. 25, 2019

(65) Prior Publication Data

US 2019/0347907 A1 Nov. 14, 2019

Related U.S. Application Data

(63) Continuation of application No. 15/812,791, filed on Nov. 14, 2017, now Pat. No. 10,417,875.

(51) Int. Cl.
*G07F 17/32* (2006.01)

(52) U.S. Cl.
CPC ..... *G07F 17/3295* (2013.01); *G07F 17/3209* (2013.01); *G07F 17/3211* (2013.01); *G07F 17/3244* (2013.01)

(58) Field of Classification Search
None
See application file for complete search history.

(56) References Cited

U.S. PATENT DOCUMENTS

| | | | | |
|---|---|---|---|---|
| 6,146,273 | A * | 11/2000 | Olsen | G07F 17/32 463/27 |
| 6,203,429 | B1 * | 3/2001 | Demar | G07F 17/32 273/143 R |
| 8,128,476 | B1 | 3/2012 | Sidhu et al. | |
| 10,210,697 | B1 | 2/2019 | Giuffria et al. | |
| 2002/0049082 | A1 | 4/2002 | Bansemer et al. | |
| 2003/0064783 | A1 | 4/2003 | Baerlocher et al. | |
| 2003/0199305 | A1 * | 10/2003 | Mathis | G07F 17/32 463/20 |

(Continued)

OTHER PUBLICATIONS

John GodGames, Pong Toss: Frat Party Games/Beer Pong—WiiWare Wii Gameplay 1080p (Dolphin GC/Wii Emulator), Jan. 12, 2015, https://www.youtube.com/watch?v=S8k1yrdnko4, p. 1 (Year: 2015).

*Primary Examiner* — Tramar Harper
(74) *Attorney, Agent, or Firm* — McAndrews, Held & Malloy, Ltd.

(57) ABSTRACT

A gaming machine having an electronic display which displays a plurality of empty drinking cups. A game controller causes the display of a ball and its movement toward and into one of the empty cups. A game play mechanism allows the player to direct the movement of the ball. If the player is successful in movement of a ball into a cup, the cup and the ball is then removed from the display. During play of the game, an amount of sobriety is determined in accord with the number of cups removed by the player. In accordance with the amount of sobriety determined, the cups are displayed in wobbling movement in order to give amusement to the game as well as difficulty in the play.

20 Claims, 8 Drawing Sheets

(56) References Cited

U.S. PATENT DOCUMENTS

2004/0048644 A1* 3/2004 Gerrard ..... G07F 17/3244 463/16
2006/0030400 A1* 2/2006 Mathis ..... G07F 17/32 463/20
2008/0153570 A1 6/2008 Esses et al.
2009/0061999 A1* 3/2009 Popovich ..... G07F 17/32 463/26
2009/0082087 A1 3/2009 Pacey et al.
2009/0117988 A1* 5/2009 Mathis ..... G07F 17/34 463/20
2009/0280891 A1* 11/2009 Filipour ..... G07F 17/3258 463/22
2010/0056243 A1 3/2010 Czyzewski et al.
2010/0056247 A1 3/2010 Nicely et al.
2010/0160030 A1* 6/2010 Indrakumar ..... G07F 17/3258 463/20
2011/0053676 A1 3/2011 Wolf et al.
2011/0065492 A1* 3/2011 Acres ..... G07F 17/3265 463/20
2011/0118011 A1* 5/2011 Filipour ..... G07F 17/32 463/27
2011/0207527 A1* 8/2011 Sims ..... G07F 17/32 463/26
2011/0244951 A1* 10/2011 Shaw ..... G07F 17/32 463/26
2012/0115581 A1 5/2012 Englman et al.
2012/0122561 A1 5/2012 Hedrick et al.
2013/0084930 A1 4/2013 Chang et al.
2014/0302898 A1 10/2014 Vann
2014/0378195 A1 12/2014 Lee et al.
2015/0375102 A1* 12/2015 George ..... A63F 13/20 463/24
2016/0343211 A1* 11/2016 Graboyes Goldman ..... G07F 17/3244
2016/0379451 A1 12/2016 Kup-Ferroth
2018/0012454 A1 1/2018 Thirumaleshwar
2018/0025588 A1 1/2018 Ma et al.
2018/0068529 A1* 3/2018 Delekta ..... G07F 17/3211
2018/0075707 A1* 3/2018 Hirai ..... G07F 17/3211
2018/0082542 A1* 3/2018 Schaefer ..... G07F 17/3209
2019/0126115 A1 5/2019 Yip

* cited by examiner

SKILL-BASED GAMING MACHINE AND METHOD THAT MAINTAIN A DESIRED RETURN TO PLAYER

RELATED APPLICATIONS

The present application is a continuation of U.S. patent application Ser. No. 15/812,791, filed Nov. 14, 2017, which is hereby incorporated by reference in its entirety.

BACKGROUND

Some age groups, particularly young people and type A males, do not tend to play slot machines. This is particularly so where little or no skill is involved in the game, and no interaction takes place with other players.

Younger people and type A males are familiar with various non-slot machine games. For example, one game of skill is a game called Beer Pong. Beer Pong is a drinking game in which two players compete against one another. Both players have 10 cups of beer in front of each of them. The players take turns throwing a Ping Pong ball at the other player's cups trying to land the ball in one of the cups. If the ball lands in a cup, the player owning the cup must drink the beer in the cup and remove the cup from in front of him or her before continuing play. The winner of the game is the last player to still have cups remaining in front of him or her.

In some existing gaming machines, a game is played in which some type of skill is required. In addition, some casino games provide "head-to-head" play where two players compete against one another.

Such head-to-head games in casinos may require a particular win/loss awarding to the players. For example, most head-to-head wagering has a "rake," i.e., a house fee that is charged, and thereafter, the wins and losses are between the players.

The need exists for new casino gaming systems and alternative methods to provide games in which skill is involved and in which competition between players may be had. Thus, the need exists for a larger variety of skill type games, which increase player enjoyment.

It is therefore an object of the present invention to provide a gaming machine that will appeal to young people and have a win distribution similar to a conventional slot machine.

It is also an object of the present invention to provide a skill based gaming machine in which the minimum and maximum return meets jurisdictional requirements and player's expectations.

It is a further object of the invention to provide a game that may be used in either a solo play or may be used in head-to-head play.

It is still a further object of the invention to provide apparatus and method to achieve competition that can be monetized in a casino.

BRIEF SUMMARY

The present invention provides a gaming machine for use by a player to play a game and for the player to exhibit skill in the play of the game. The level of skill exhibited, i.e., the ability of the player to do well, is first determined and then used to alter the game. Further, in a one player embodiment, the greater the skill put forth by the player increases the difficulty in play by that player in playing the game. In a two player embodiment, the greater the skill put forth by one player increases the difficulty in play by the other player in playing the game.

In addition, the gaming machine is configured to control the win outcomes so as to meet casino's and state's requirements for a wagering.

Further, a method of gaming is disclosed.

In an embodiment, the game includes a selector used by the player to demonstrate skill in the throwing of or directing of a visual ball symbol across a video display toward a visual cup symbol. Based on the play, a skill factor is determined and then used to juggle or jostle the cup targets on the display through movement thereof, and thus make the game more difficult. Such a juggling of targets increases during play as the determined skill level increases. However, such an action is done to facilitate amusement, particularly with two players playing.

In some embodiments, in order to control the minimum and maximum return of the game, a "Kitty" is used. Such a Kitty provides a significant prize amount to the winning player. An ancillary use of a Kitty may be to hold the credits from a lower expected return table. However, such lower credit awards need not be returned in this manner. In such embodiments, the game reveals to the players that no credits are immediately awarded to the player making a bad shot.

For example, in a game, credits are awarded whether the ball lands in a cup or not. A random credit amount awarded for a missed shot comes from a table with a lower expected return than a table used for a "hit" (movement of a ball into a cup). Both of these credit amounts are randomly selected from their respective tables. On a hit, an amount is revealed (randomly selected) from a weighted table A, and that amount is awarded to the player scoring the hit. This awarding is performed to the winning player immediately at the time of the ball movement into the cup. An amount equal to that awarded amount is placed into a Kitty. The game display may visually show the Kitty amount increasing as the game is played. The Kitty will only be awarded to the winning player. On a miss, an amount is revealed (randomly selected) from a weighted table B and that entire amount is placed into the Kitty. The game display shows/reveals that no credits are immediately awarded to the player making a bad shot. Because the values from table A have an expectation of a maximum return to a player (MaxRTP) and the values from table B have an expectation of a minimum return to a player (MinRTP), over time the game will return to the players an amount of money to meet the regulatory and casino needs and satisfy the expectation of players who may not want to play a game where a percentage of their wagers over time is returned to them.

BRIEF DESCRIPTION OF THE DRAWINGS

Embodiments of the disclosure will now be described with reference to the accompanying drawings in which.

DETAILED DESCRIPTION OF THE PREFERRED EMBODIMENT

Figure 1:
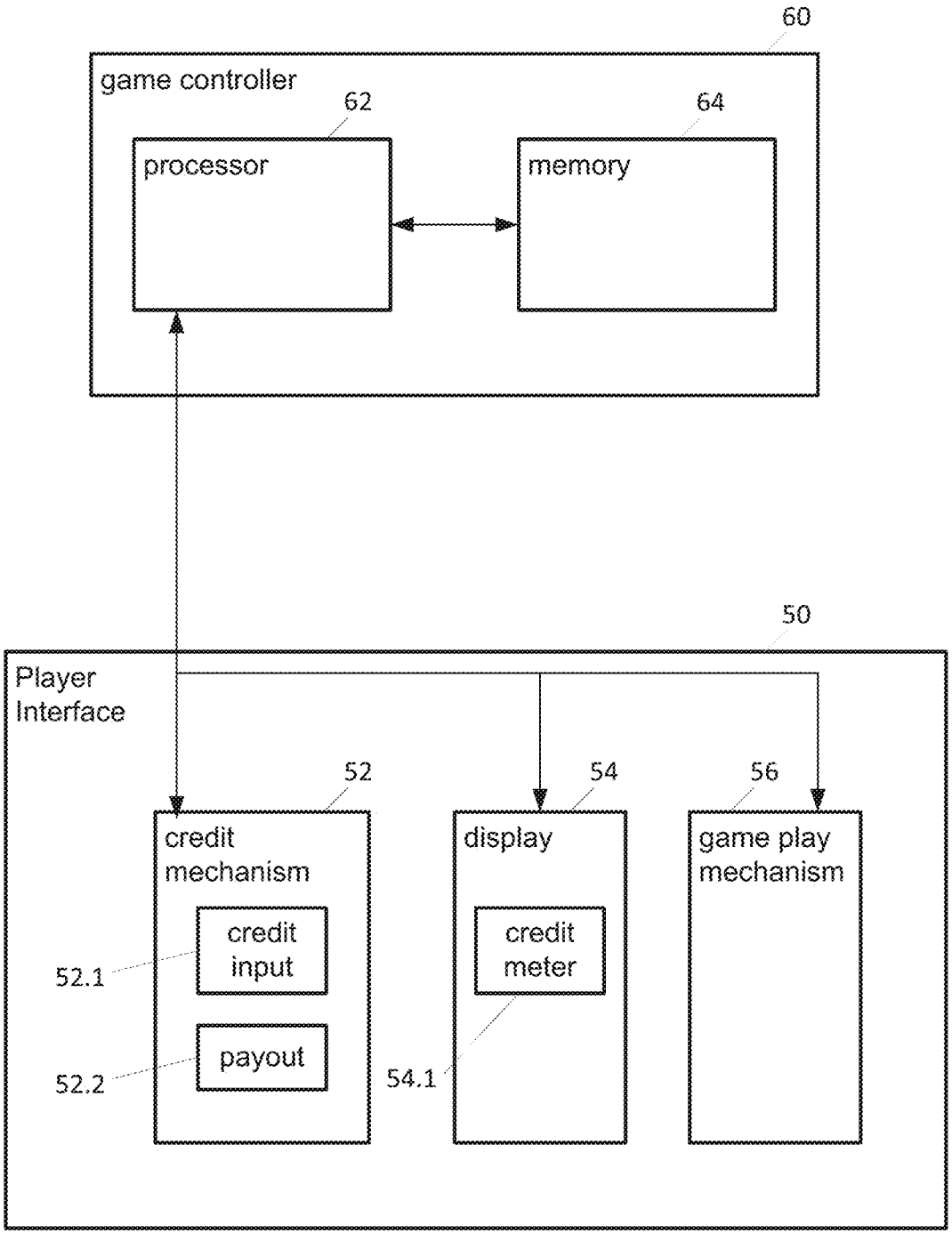
FIG. 1 is a block diagram of the core components of a gaming machine according to an embodiment of the present invention.

Referring to the drawings, there is shown an embodiment of a gaming machine having an electronic display which displays a plurality of empty drinking cups, e.g., beer cups. The gaming machine also includes a game controller to cause the display of a ball, e.g., a ping pong ball, and to control visual movement of the ball toward and into one of the empty cups. The movement of the ball is controlled by the player using a game play mechanism. The player sets the path of the ball to align with a cup, and then releases the ball for movement toward the cup. The player is given ten balls, for example, to "throw" into ten cups.

If the player is successful in movement of a ball into a cup, the cup and the ball are then removed from the display, and, for example, may be used to indicate that the player has drank a cup of beer.

During play of the game, an amount of sobriety is determined in accord with the number of cups removed by the player, e.g., as an indication of an amount of beer drank by the player. In accordance with the amount of sobriety determined, the cups may be displayed in movement or wobbling (as though this is what an intoxicated person might see) in order to give amusement to the game as well as difficulty in the play. The movement increases as more and more cups are removed.

Prizes are awarded to the player in accord with the number of cups removed.

General Construction of the Gaming System

The gaming system can take a number of different forms. In a first form, a standalone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, architecture may be provided wherein a gaming machine is networked to a gaming server and the respective functions of the gaming machine and the gaming server are selectively modifiable. For example, the gaming system may operate in standalone gaming machine mode, "thick client" mode or "thin client" mode depending on the game being played, operating conditions, and so on. Other variations will be apparent to persons skilled in the art.

Referring to FIG. 1, the gaming system has several core components. At the broadest level, the core components are a player interface 50 and a game controller 60 as illustrated in FIG. 1. The player interface 50 may enable manual interaction between a player and the gaming system and for this purpose includes the input/output components required for the player to enter instructions to play the game and observe the game outcomes.

Components of the player interface may vary from embodiment to embodiment but will typically include a credit mechanism 52 to enable a player to input credits. For example, in some embodiments, the credit mechanism 52 may include a credit input mechanism 52.1 to receive a physical item representing a monetary value for establishing a credit balance. The credit balance may be increasable and decreasable based wagering activities. In accord with the established credit balance, the player places a wager and the gaming system initiates a game. In some embodiments, the credit mechanism 52 also includes a payout mechanism 52.2 to cause a payout associated with the credit balance. The player interface may also include one or more displays 54, a game play mechanism 56 including one or more input devices that enable a player to input game play instructions (e.g. to place a wager), and one or more speakers (not shown). In some embodiments, each of the displays 54 includes a plurality of display positions. In other embodiments, each of the displays 54 includes a plurality of display areas. As shown in FIG. 1, the display 54 also includes a credit meter 54.1. In some embodiments, the credit meter 54.1 displays credits available, credits bet, and/or credits won.

The game controller 60 is in data communication with the player interface 50 and typically includes a processor 62 that processes the game play instructions in accordance with game play rules and outputs game play outcomes to the display(s) 54. Typically, the game play rules are stored as program code in a memory 64 but can also be hardwired. In some embodiments, the memory 64 may also store data indicative of a plurality of symbols, pay tables, images, and other information to be used in games. Herein the term "processor" is used to refer generically to any device that can process game play instructions in accordance with game play rules and may include: a microprocessor, microcontroller, programmable logic device or other computational device, a general purpose computer (e.g. a PC) or a server. That is, a processor may be provided by any suitable logic circuitry for receiving inputs, processing them in accordance with instructions stored in memory and generating outputs (for example on the display). Such processors are sometimes also referred to as central processing units (CPUs). Most processors are general purpose units, however, it is also know to provide a specific purpose processor using an application specific integrated circuit (ASIC) or a field programmable gate array (FPGA).

Figure 2:
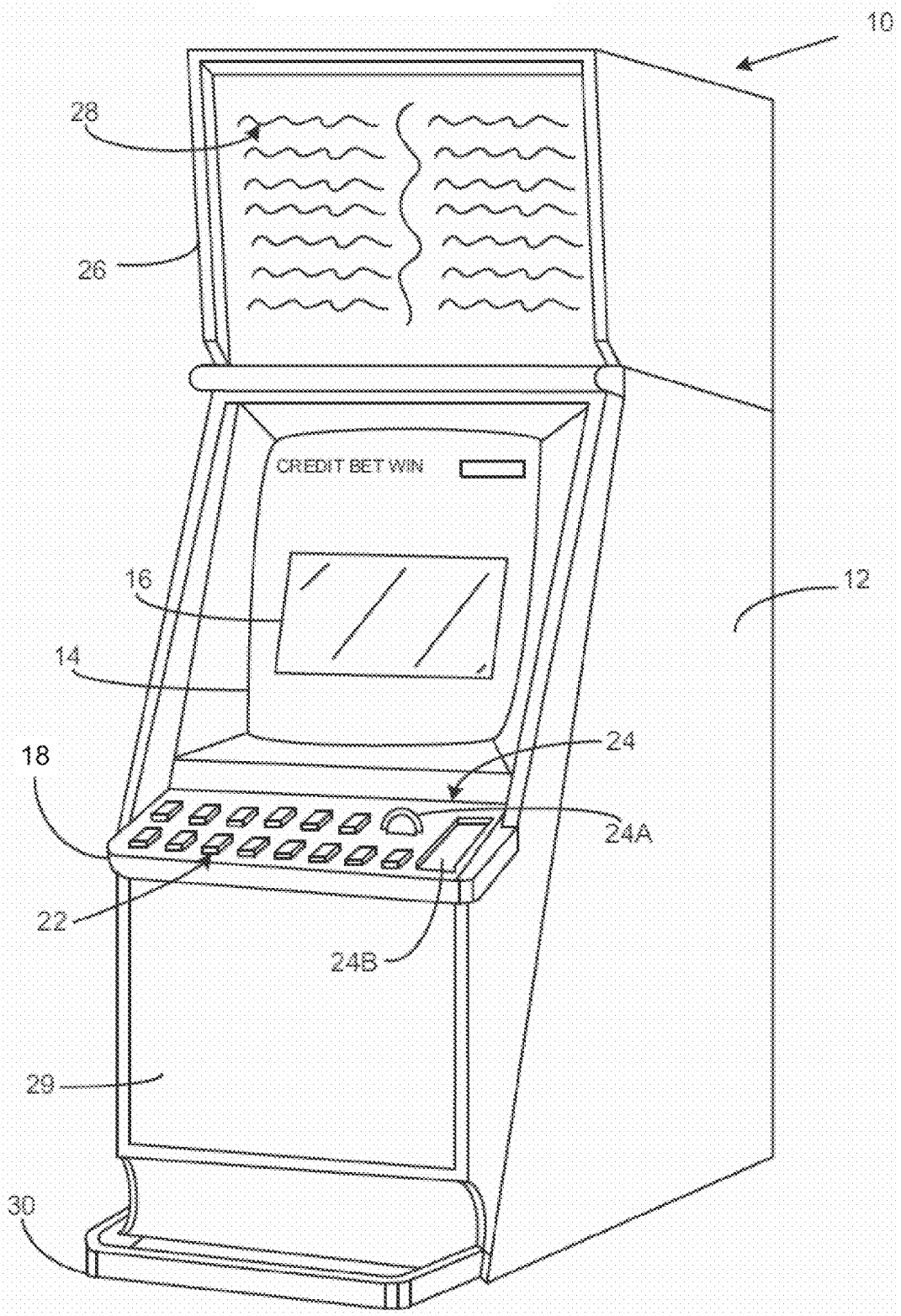
FIG. 2 is a perspective view of a standalone gaming machine.

Referring to FIG. 2, a gaming system in the form of a standalone gaming machine 10 includes a console 12 having a display 14 on which are displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 (similar to the credit input mechanism 52.1 of FIG. 1) which in this example includes a coin input chute 24A and a bill collector 24B. Other credit input mechanisms may also be employed, for example, a card reader for reading a smart card, debit card or credit card. Other gaming machines may be configured to accept a ticket such that the credit input mechanism 24 may have a ticket reader (not shown) for reading tickets having a value and crediting the player based on the face value of the ticket. A player marketing module (not shown) having a reading device may also be provided for the purpose of reading a player tracking device, for example as part of a loyalty program. The player tracking device may be in the form of a card, flash drive or any other portable storage medium capable of being read by the reading device. In some embodiments, the player marketing module may provide an additional credit mechanism, either by transferring credits to the gaming machine from credits stored on the player tracking device or by transferring credits from a player account in data communication with the player marketing module.

A top box 26 may carry artwork 28, including for example pay tables and details of bonus awards and other information or images relating to the game. Further artwork and/or information may be provided on a front panel 29 of the console 12. The gaming machine 10 also includes a payout mechanism in the form of a coin tray 30 that is mounted beneath the front panel 29 for dispensing cash payouts from the gaming machine 10. Another form of a payout mechanism may include an embedded printer to print out a payout ticket associated with the credit balance that may be redeemed at a cage (not shown).

Display 14 shown in FIG. 2 is in the form of a liquid crystal display. Alternatively, the display 14 may be a light emitting diode display, plasma screen, and/or any other suitable video display unit. The top box 26 may also include a display, for example a video display unit, which may be of the same type as the display 14, or of a different type.

Figure 3:
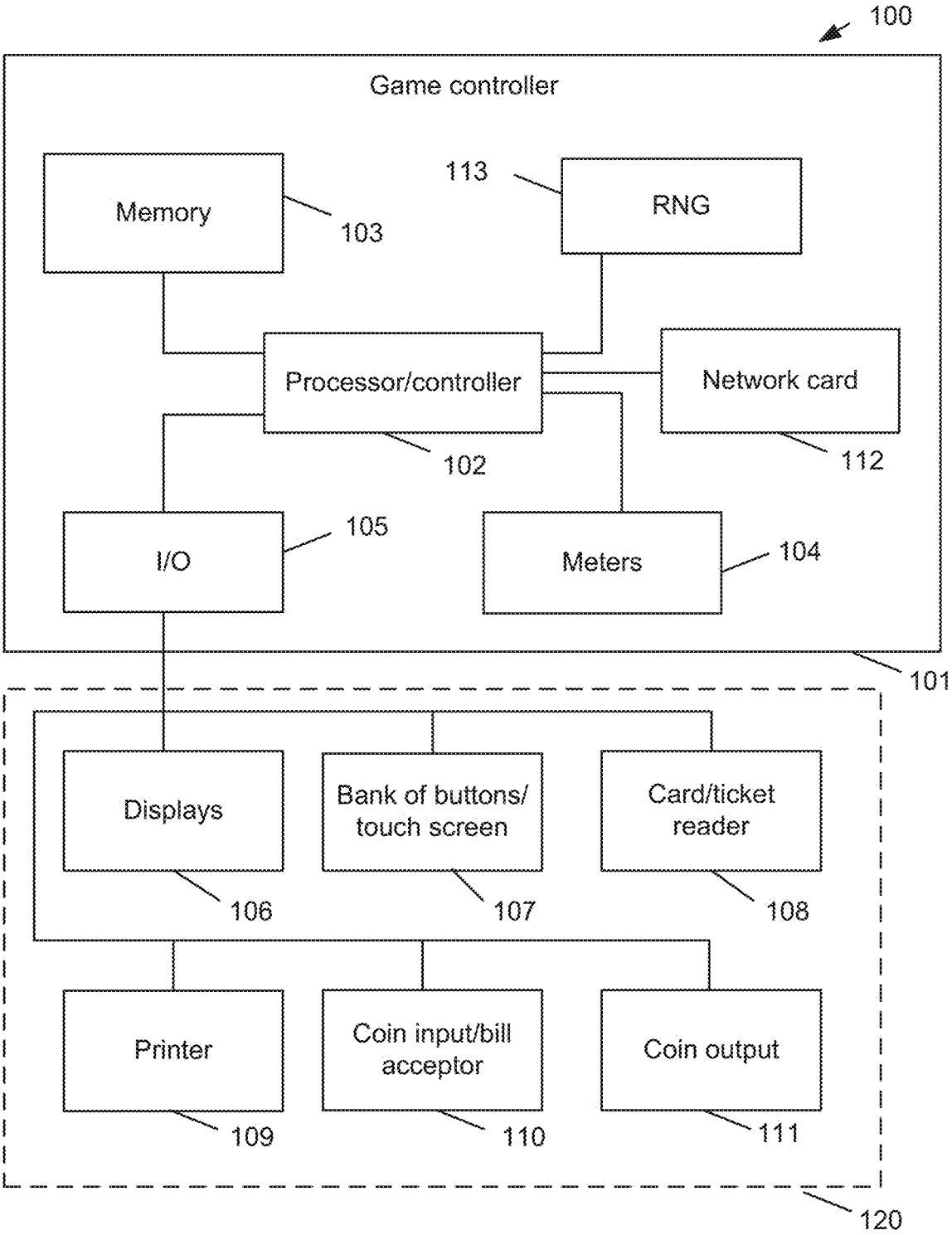
FIG. 3 is a block diagram of the functional components of a gaming machine.

FIG. 3 shows a block diagram of operative components of a typical gaming machine 100 which may be the same as or different to the gaming machine of FIG. 2.

Gaming machine 100 of FIG. 3 includes a game controller 101 having a processor 102 mounted on a circuit board. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

Gaming machine 100 has hardware meters 104 for purposes including ensuring regulatory compliance and monitoring player credit, an input/output (I/O) interface 105 for communicating with peripheral devices of the gaming machine 100. Input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 including one or more displays 106, a touch screen and/or buttons 107 (which provide a game play mechanism), a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation. For example, while buttons or touch screens are typically used in gaming machines to allow a player to place a wager and initiate a play of a game, any input device that enables the player to input game play instructions may be used. For example, in some gaming machines a mechanical handle is used to initiate a play of the game. Persons skilled in the art will also appreciate that a touch screen can be used to emulate other input devices, for example, a touch screen can display virtual buttons which a player can "press" by touching the screen where they are displayed.

In addition, gaming machine 100 may include a communications interface, for example a network card 112. The network card may, for example, send status information, accounting information or other information to a bonus controller, central controller, server or database and receive data or commands from the bonus controller, central controller, server or database. In embodiments employing a player marketing module, communications over a network may be via player marketing module—i.e. the player marketing module may be in data communication with one or more of the above devices and communicate with it on behalf of the gaming machine.

Figure 4:
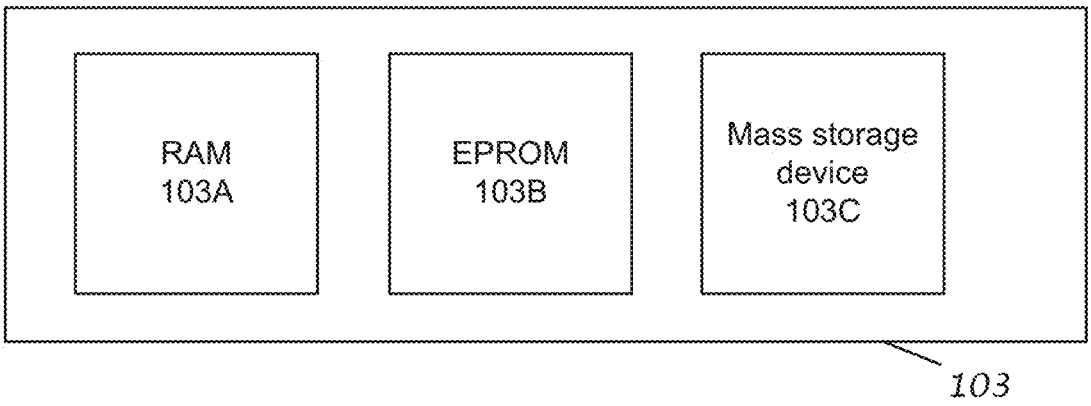
FIG. 4 is a schematic diagram of the functional components of a memory.

Referring now to FIG. 4, the main components of an exemplary memory 103 include RAM 103A, EPROM 103B and a mass storage device 103C. RAM 103A typically temporarily holds program files for execution by the processor 102 and related data. EPROM 103B may be a boot ROM device and/or may contain some system or game related code. Mass storage device 103C is typically used to store game programs, the integrity of which may be verified and/or authenticated by processor 102 using protected code from EPROM 103B or elsewhere.

It is also possible for the operative components of the gaming machine 100 to be distributed, for example input/output devices 106, 107, 108, 109, 110, 111 to be provided remotely from the game controller 101.

Figure 5:
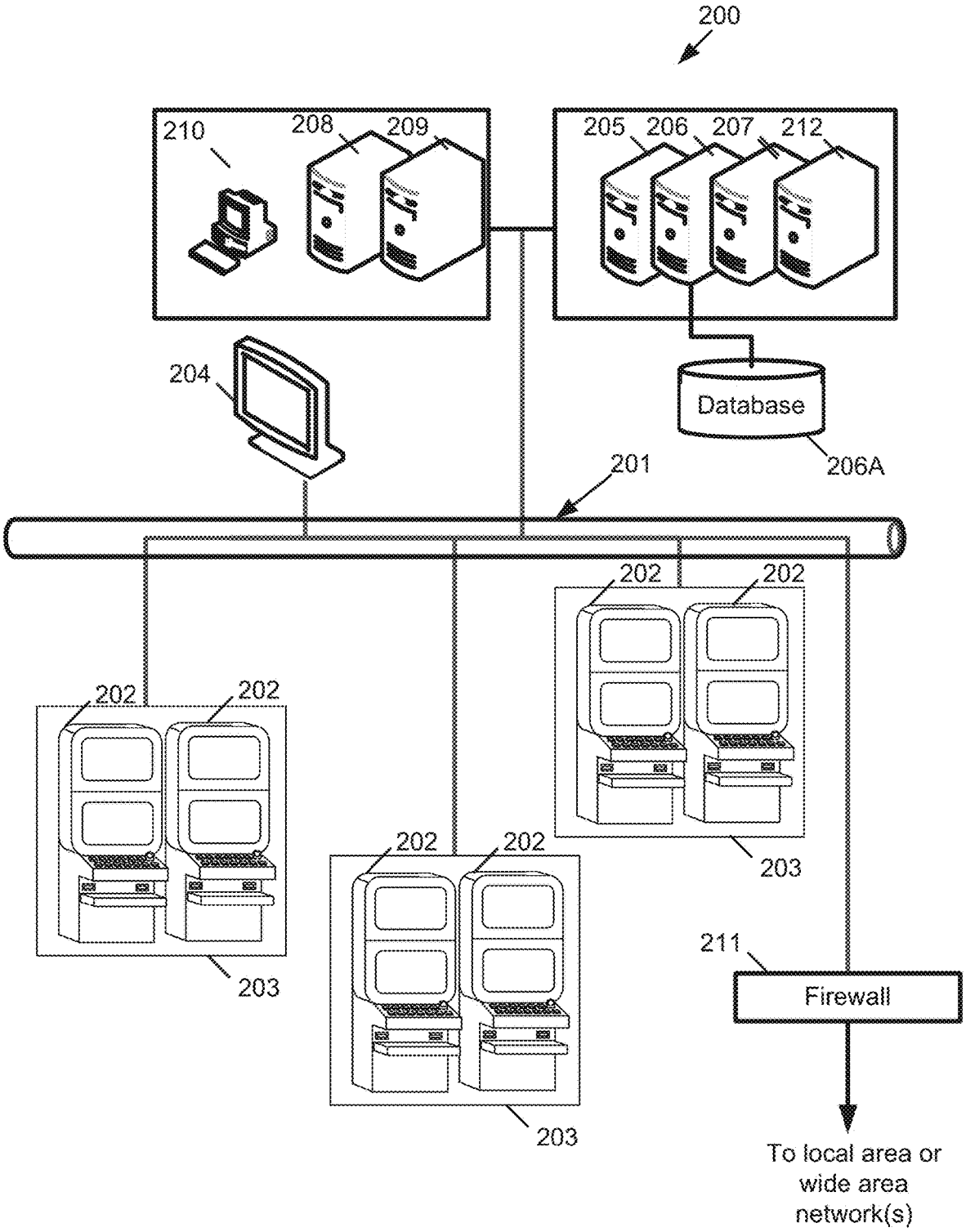
FIG. 5 is a schematic diagram of a network gaming system.

Referring to FIG. 5, a gaming system 200 in accordance with an alternative embodiment includes a network 201, which for example may be an Ethernet network. Gaming machines 202, shown arranged in three banks 203 of two gaming machines 202, are connected to network 201. Gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to network 201. For example, displays 204 may be associated with one or more banks 203 of gaming machines. Displays 204 may be used to display representations associated with game play on gaming machines 202, and/or used to display other representations, for example promotional or informational material.

In a thick client embodiment, a game server 205 implements part of the game played by a player using a gaming machine 202, and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to perform accounting functions for the Jackpot game. A loyalty program server 212 may also be provided.

In a thin client embodiment, game server 205 implements most or all of the game played by a player using a gaming machine 202 and the gaming machine 202 essentially provides only the player interface. With this embodiment, game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components. Other client/server configurations are possible, and further details of a client/server architecture can be found in WO 2006/052213 and PCT/SE2006/000559, the disclosures of which are incorporated herein by reference.

Servers are also typically provided to assist in the administration of gaming network 200, including for example a gaming floor management server 208, and a licensing server 209 to monitor the use of licenses relating to particular games. An administrator terminal 210 is provided to allow an administrator to run network 201 and the devices connected to the network.

Gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of game servers could be provided to run different games or a single game server may run a plurality of different games as required by the terminals.

Further Detail of Gaming System

When credit input mechanism 52.1 (FIG. 1) has received a physical item representing a monetary value, a credit balance is established. The player may then operate the game play mechanism 56 (FIG. 1) to specify one or more of a plurality of wagers for the game and to initiate a play of the game. As described below, in one embodiment the player makes a wager each time the player throws a ball. In some embodiments, when the credit input mechanism 52.1 (FIG. 1) has received a physical item representing a monetary value for establishing a credit balance, at least a portion of the received physical item may initiate a play of the game directly.

Figure 6:
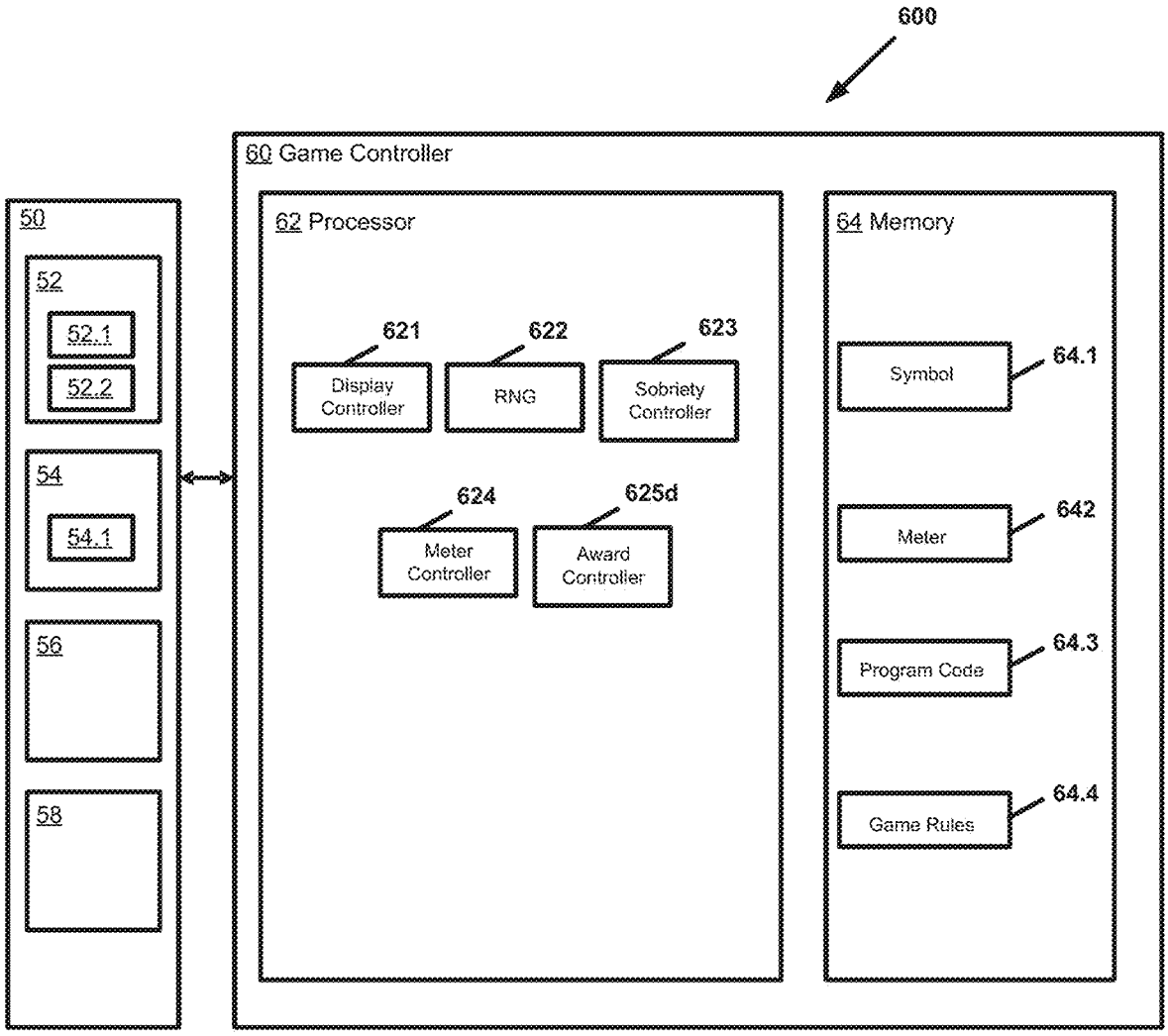
FIG. 6 is a schematic block diagram of the core components of the gaming machine of FIG. 1.

Referring now to FIG. 6, gaming machine 600 (similar to the gaming machine 10 of FIG. 2) includes a game controller 60. Game controller 60 includes a processor 62 and a memory 64. Memory 64 includes a symbol memory module 64.1 that stores data of a plurality of items, e.g., visuals and/or symbols including a drinking cup symbol and a ball symbol, a meter memory module 64.2 that stores meter data of gaming machine 600, and a program code memory 64.3 that stores program code to implement a number of modules to be executed by processor 62. In the embodiment, memory 64 also includes a game rules memory module 64.4 that stores a plurality of game rules.

Persons skilled in the art will appreciate that some or all of the components of the game controller 60 could be alternatively implemented. For example, in some embodiments, the game controller 60 and its components are implemented in the form of a dedicated circuit, or an individual application-specific-integrated-circuit (ASIC). In other embodiments, game controller 60 and its components is implemented as an individual ASIC. In other embodiments, some or all of the game controller components may be individually or collectively implemented as software modules, controllers, and/or circuitries.

In the embodiment, game controller 60 includes a display controller 621 which is configured to control display 54 and a random number generator (RNG) 622 configured to generate a random number. Game controller 60 also includes a meter controller 624 configured to generate meter data, for example, for display or storage based on game play, and/or to read meter data from the meter memory 64.2. Game controller 60 also includes a sobriety controller 623 to determine a number representing sobriety (or lack thereof) and an award controller **625*d*** to determine an award amount based on play of the game.

Figure 7:
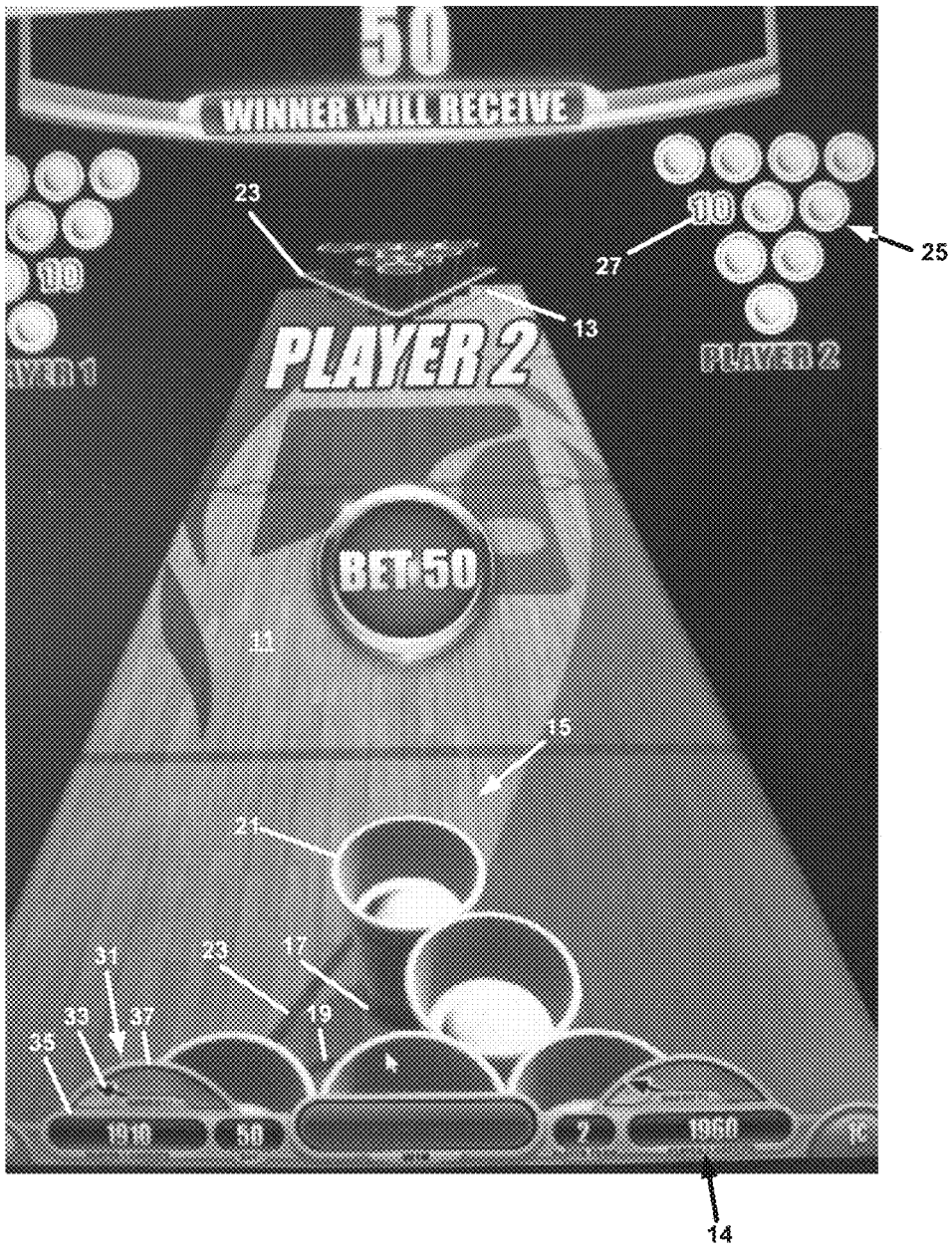
FIG. 7 is a display screen picture of an embodiment of the gaming machine of FIG. 1

Referring to FIG. 7, in one embodiment two players can play the game. An alley 11 is visually displayed on the display 14, and alley 11 has a form similar to a bowling alley. Two groups 13, 15 of ten separate display positions 17 are located at opposite ends of alley 11. Each of the ten display positions 17 may include a circle 19 drawn on alley 11 and sized to receive the base of a single cup 21.

The ten display positions 17 are arranged in a triangular configuration similar to an array of pins in a bowling alley. Four cups 21 are positioned along each side of the triangular configuration. A visual triangle indicator 23 may appear surrounding the cups.

The game is played by the player causing a ball (not shown) to be visually thrown down the alley toward a cup 21 of one group in an attempt to land the ball in the cup. If successful, the particular cup 21 and the ball are removed from display 14.

As shown in FIG. 7, nine cups 21 are displayed in each of the two groups 13, 15. A single cup 21 appears missing from a display position 17, in each group, the cup having been removed during play of the game.

Two game play indicators 25 are displayed to show the player which cups have been removed, and the score for the removed cups. Each indicator 25 provides a top view of each cup 21 that remains displayed in the associated group 13, 15. The indicator on the left is partially shown in FIG. 7, but will look and function as the indicator on the right, and each are labeled either PLAYER 1 or PLAYER 2. In addition, indicator 25 displays a number 27, representing a score amount, for example a number of credits, and located at a position representing the display position 17 where a cup 21 was removed to win the score amount 27. As play continues, game play indicator 25 shows more score amounts 27 in cup positions as more cups 21 are removed from display positions 17. In addition, the credits from landing in a cup may go directly to the credit meter of the player throwing the ball.

The play may continue until all cups are removed or one player chooses to "walk away." With an award of 10 credits per cup, for example, 100 credits in total may be won. Alternatively, the player may walk away, i.e., be allowed to stop play of the game and obtain the credits won thus far in the game.

The player makes a wager of, for example, 5 credits each time a ball is thrown. Thus, for example, if the player throws twelve times to remove all ten cups, the total wager would be 60 credits and the player would win 100 credits. Alternatively, the separate wager amount for each throw may be increased as the number of throws increases, or the separate wager amount may be increased each time a cup is removed.

In addition, the score amount 27 may be associated with a value in credits that is drawn from a weighted table. The weighted table may be tuned to a return of a maximum RTP (return to player) based on a perfect play.

As an alternative, when a cup is removed, half of the associated value of the cup goes to the player throwing the ball, and the other half is placed in a "Kitty" or prize pool for the awarding to the eventual winner of the two player game. This Kitty may be displayed to the players so that its value is known and is seen changing as the game is played. As seen in FIG. 7, a "Winner Receives" meter shows the Kitty amount.

This associated value of the removed cup may be fixed, as described above as for example 10 credits. Alternatively, the associated value may be selected randomly from a weighted table.

Also, when a ball is thrown that misses a cup, a random selection is made from another weighed table having an average value of the minimum allowed RTP and all of the selected value is added to the Kitty and nothing is given to the player that missed the cup.

Credits are awarded for landing in the last cup as well as added to the "Winner Receives" meter and then that amount is award to the winner.

The following is an example of a weighted table. The maximum return to player, RTP, is 92% and the minimum RTP is 86%. The expected value of the game always remains between 86% and 92%.

| Cup Credit Values | | Miss Credit Values | |
|---|---|---|---|
| Values | Weights | Values | Weights |
| 10 | 437 | 10 | 1074 |
| 20 | 2000 | 20 | 2000 |
| 30 | 1000 | 30 | 1000 |
| 40 | 994 | 40 | 975 |
| 50 | 35 | 50 | 35 |
| 60 | 20 | 60 | 20 |
| 80 | 20 | 80 | 20 |
| 90 | 20 | 90 | 20 |
| 100 | 20 | 100 | 20 |
| 120 | 20 | 120 | 20 |
| 140 | 20 | 140 | 20 |
| 160 | 20 | 160 | 20 |
| 180 | 10 | 180 | 10 |
| 200 | 7 | 200 | 7 |
| 240 | 6 | 240 | 6 |
| 280 | 6 | 280 | 7 |
| 300 | 6 | 300 | 7 |
| 350 | 6 | 350 | 6 |
| 400 | 5 | 400 | 5 |
| 500 | 5 | 500 | 5 |
| 600 | 5 | 600 | 5 |
| 700 | 5 | 700 | 5 |
| 800 | 5 | 800 | 5 |
| 1000 | 14 | 1000 | 15 |
| 1200 | 3 | 1200 | 3 |
| 1500 | 3 | 1500 | 3 |
| 2000 | 2 | 2000 | 2 |
| 2500 | 1 | 2500 | 2 |
| 3000 | 1 | 3000 | 2 |
| 5000 | 1 | 5000 | 1 |
| 6000 | 1 | 6000 | 1 |
| 7500 | 1 | 7500 | 1 |
| 10000 | 1 | 10000 | 1 |

When the player misses a shot, an amount from the "Miss Credit Values table above is added to the Kitty for later award to the winning player.

The Kitty is awarded to the winning player, i.e., the player who has a cup remaining when the last cup of the other player is removed. Also, the Kitty is awarded to the player who did not walk away from the game when the other player walked away. The player who walks away or chooses not to continue within an allotted time, forfeits the Kitty amount to the other player.

The player must launch the ball so as to land in a cup, either directly into the cup or with one bounce and then into the cup.

Further, the players may agree to split the Kitty. Again this may be selected by a player at the player interface 50 (FIG. 6). And, in the circumstances of a tie, a limited number of tie-breaker rounds may be played, and with the Kitty being split if the winner is still unresolved at the end of the tie-breaker rounds.

Sobriety controller 623 (FIG. 6) causes display of a sobriety indicator 31 of FIG. 7. There may be two sobriety indicators 31, one for each of the two players. Sobriety indicator 31 has an arrow 33 for visually defining the amount of sobriety of the player. Arrow 33 begins at a position 35 on a semicircle line 37 pointing toward the left. Arrow 33 then rotates clockwise relative to semicircle line 37 as the player's sobriety decreases. The further the arrow moves along the semicircle line, the further the player's lack of sobriety.

Sobriety controller 623 (FIG. 6) determines the value of sobriety based on the number of cups that are removed. That is, the sobriety meter determines sobriety (or lack thereof) of a player based on the number of that player's cups that have been removed from the game. The representation being that that player has drunk the beer in the number of that player's cups that have been removed. This is so whether a two player game or a single player game is being played. Thus, the sobriety meter will change from the number 0 to the number 10.

The sobriety meter controls the amount of distortion/wobbliness/movement of cups 15 on the display 11, which cups are cups of the other player. That is, the player has an associated sobriety factor (0 to 10) which is used to control distortion as that player attempts to remove cups belonging to the other player, in a two player game. The larger the value of sobriety (between 0 and 10) the greater the movement caused to the cups (representative of a greater level of drunkenness of the player throwing the ball). This movement affects the visual position of the cups 21, and thus may affect the player's ability to throw a ball 19 into a cup 21. Thus, the path of the ball, and the speed of the ball relative to the sobriety movement of the cups 21 become important to the player. For example, if a cup 21 has a side-to-side movement (a wobble) that is slow, and the movement of the ball towards the cup is slow, the player must use skill in selecting the path of movement of the ball to align with the position that the cup will take when the ball reaches the cup.

Figure 8:
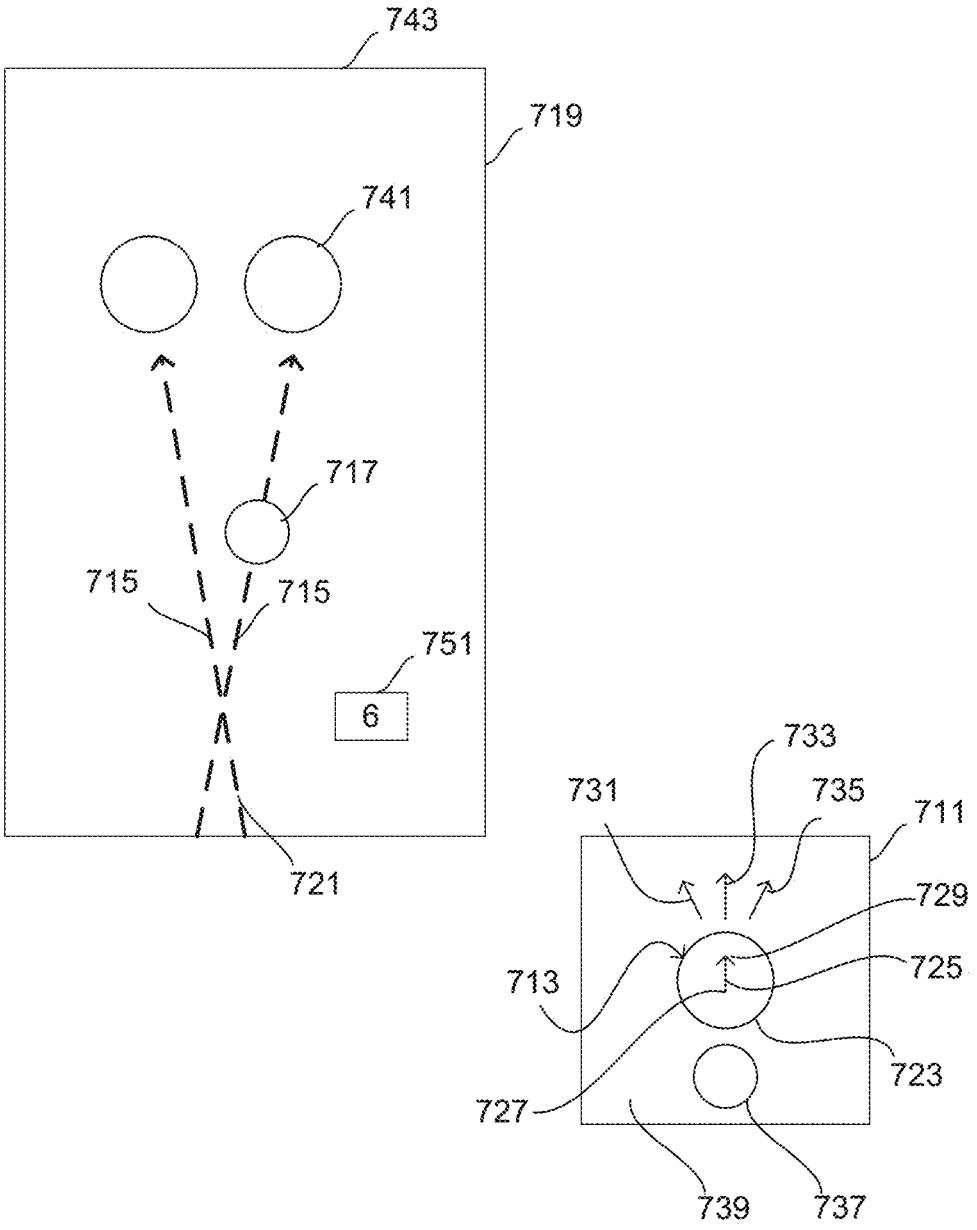
FIG. 8 is a diagram schematic of the components of the gaming machine of FIG. 1.

Referring to FIG. 8, a player actuable mechanism 711 forms part of the game play mechanism 56 of FIG. 1. Player actuable mechanism 711 provides two separate selections for use by the player. The first selection is made by a direction setter 713 which sets the angle or the path 715 that a ball 717 travels across a display 719 beginning from a start position 721. Direction setter 713 may take on various forms including a rotatable knob 723 upon which is fixed an arrow 725. As knob 723 is rotated by the player, the bottom point 727 of arrow 725 is located at the center of the knob and so does not change positions, but arrow head 729 rotates. Separate arrows 731, 733, 735 remain fixed on mechanism 711 and serve to provide a visual gauge for the player and against which arrow 725 may be compared so that the player may learn and select the path for ball 717.

After the path has been selected by the player using direction setter 713 to position arrow 725, an actuator button 737 is pressed by the payer to initiate movement of ball 717 along the path 715 selected by the player. Alternatively, knob 723 may also perform the function of initiation of ball movement by the player pressing down on knob 723.

As ball 717 moves along the selected path, it may engage cup 741. That is, the visual image of ball 717 moves atop the visual image of a cup 741 and then caused to enter the cup. Instead, ball 717 may miss cup 741 passing by the cup and then moving off of display 719 at its boundary 743. If ball 717 engages cup 741, cup 741 and ball 717 are both removed from display 719.

Alternatively, a direction setter embodiment may be in a form allowing a finger swipe of the player. The player uses his/her finger and swipes the display 719 at various angles in order to select path 715 that ball 717 travels. Also, shown in FIG. 7 between the two sobriety indicators 31 that are located at the bottom of the display is displayed a semicircle with an arrow pointing upward; the arrow may be moved by the player's finger along the semicircle to point in different directions to set the direction of the ball movement. Below that semicircle is a red button which may be touch actuated by the player to release the ball similar to the function of actuator button 737 of FIG. 8.

Alternatively, game play mechanism 56 may comprise a drag and release aiming mechanism.

In addition, player actuable mechanism 711 may provide a color change to indicate the quality of the throw of the player. For example, player actuable mechanism 711 may change colors to indicate that ball 717 will move into the triangle 23 (FIG. 7), but does not guarantee that ball 717 will pass into cup 741. This color change may occur on a display background 739 of mechanism 711, or at another location. The background 739 may turn red or green, for example.

The player must launch the ball so as to land in a cup, either directly into the cup or with one bounce and then into the cup. The targeting tool may be arranged so as to turn green when the ball is properly aimed to move inside the triangle 23 (FIG. 7) surrounding the cups.

After playing the game time after time, a player may develop a perfect skill in throwing the ball and is thus able to remove the ten cups with ten throws. Such a player will always win if that player goes first in a two player game. Therefore, a "Tie Breaker" operation is employed. When Player One (who shot first) makes the ball in the last cup of Player Two and Player One only has 1 cup remaining, Player Two is given one last attempt to remove Player One's remaining cup. If Player Two, on this last attempt, makes the ball into Player One's last cup, a tie exists and play will continue until one of the two players makes the shot and the other does not. This continued play will continue with the difficulty increasing until a maximum difficulty is reached or a fixed number of attempted tie-breaking turns occurs. At which time, the Kitty will be split evenly between the two players and the game finishes in a tie.

As shown in FIG. 8, a meter display 751 may be used on display 719 and displays a number to the player. As shown, the number "6" is displayed. The number serves to identify the number of cups of the other player that have been removed from display 719. The game ends when meter display 751 displays the number 10 indicating that all 10 cups of the other player have been removed from the display.

If two players play the game and compete for a prize, two like displays 719 may be used, one for each player. The players may take turns moving/throwing the ball, such that only one of the two displays appears at a time; or if both displays are present, only one is operable at a time. Once a cup is removed or the ball moves off the display, then that display is stopped and the other display is enabled.

Alternatively, with two players, only one display 719 may be used and each separate play is successively presented to each player. The display is provided for play by the first player, and then the game is switched on the display to a new play for the next player.

Alternatively, with two players, the display may take the form of that shown in FIG. 7 where two groups of cups appear, one group at each end of the alley. In such a form shown in FIG. 7, groups 13 and 15 of the cups may switch positions. The player may be identified by placing the words "PLAYER 2" on the display as shown in FIG. 7, or placing the words "PLAYER 1" on the display. When player #2 plays, the cups of player #1 are presented at the far end of the alley for targets for player #2's throwing of a ball. After player #2's throw, player #1 plays and the cups of player #2 are presented at the far end of the alley for targets for player #1's throwing of a ball. Player #1 and player #2 take turns playing by throw of one ball in each turn.

Referring to FIG. 7, game display 14 may display meter values indicating the amount of credits belonging to each player, a wager button to continue play, a "walk away" button to choose to end the game, etc. In other embodiments, a single player version may be provided. Also, a single pay version for two players may be provided where the cost to play is paid up front and misses do not contribute to a Kitty. Also, display 14 may be horizontally disposed, i.e., parallel to the floor, and the two players stand at opposite ends of the display Further, it is not necessary that the two players be playing on the same machine but are playing separate machines connected to a network, for example.

In addition, side wagering could occur between the two players or between spectators of the game. Such side wager bets may be made via the same or separate touch screen graphical interface the players are using in a public or digital setting. Also, such side wager bets may be made via personal hand-held devices or via linked additional terminals in or near the location of the game being played.

Some examples of such side wagers include a bet that:

The next player will miss his or her shot.

Player X will miss his or her next shot.

The next player will make his or her next shot.

Player X will make his or her next shot.

Player X will win

These side wagers could be offered by a single player or spectator to the community at large with or without odds, and then be accepted in whole or in part by other player(s) or spectator(s). The house (e.g., the casino) would then take a rake percentage of the transaction for facilitating the wager and tracking and transferring of money.

For example, Player A is about to take a turn. Player A offers a wager of 500 credits to anyone who will accept it and is confident enough to offer the wager at 2:1 odds. Another player with credits available accepts the offered wager, but only in the amount of 200 credits. At 2:1 odds, the accepting player has taken 400 credits of the offered "action". This leaves 100 credits still available of the offered wager that may or may not be accepted by some other player. Regardless of the outcome of the bet, there are now 600 credits at stake of which, the house will take a rake (of, say 5% or 30 credits) leaving the remainder (570 credits) to the winner of the wager.

Another form of wager could be pari-mutuel in nature, for example, in a public or digital setting, thirty (30) active participants have credits available to be wagered. Five (5) of these thirty participants choose to predict "Player A will make his next shot," and these five participants each back their prediction with separate wagers of $2, $2, $5, $5, and $1, respectively. Two (2) of the remaining thirty participants take the opposite side of the prediction and bet "Player A will miss his next shot," and these two participants each back their prediction with separate wagers of $2 and $5, respectively.

Thus, there is a total of $22 dollars wagered, which is placed in a pool. Of this $22 pool, the house will remove a fixed amount (a rake). For example, a 5% share goes to the house, i.e., $1.10. This leaves $20.90 in the pool to be awarded. If Player A does make his next shot, then the 5 players who correctly predicted the outcome will split the $20.90 in amounts proportionate to their wager amount of $15. Thus, for the participant who wagered $2, the share of the pool is 2/15*$20.90 equaling $2.79.

Conversely, If Player A missed his next shot, the same $20.90 would be split into portions of 2/7ths and 5/7ths for the participants wagering $2 and $5 respectively. Thus, $5.97 is awarded to the person wagering $2 and $14.93 is awarded to the person wagering $5.

Further aspects of the apparatus and method will be apparent from the above description of the system. It will be appreciated that at least part of the method will be implemented electronically, for example, digitally by a processor executing program code such as in the above description of a game controller. In this respect, in the above description certain steps are described as being carried out by a processor of a gaming system, it will be appreciated that such steps will often require a number of sub-steps to be carried out for the steps to be implemented electronically, for example due to hardware or programming limitations. For example, to carry out a step such as evaluating, determining or selecting, a processor may need to compute several values and compare those values.

As indicated above, the method may be embodied in program code. The program code could be supplied in a number of ways, for example on a tangible computer readable storage medium, such as a disc or a memory device, e.g. an EEPROM, (for example, that could replace part of the memory) or as a data signal (for example, by transmitting it from a server). Further different parts of the program code can be executed by different devices, for example in a client server relationship. Persons skilled in the art will appreciate that program code provides a series of instructions executable by the processor.

It will be understood to persons skilled in the art of the invention that many modifications may be made without departing from the spirit and scope of the invention. In particular, it will be apparent that certain features of embodiments of the invention can be employed to form further embodiments.

It is to be understood that, if any prior art is referred to herein, such reference does not constitute an admission that the prior art forms a part of the common general knowledge in the art in any country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A gaming machine that provides a skill-based game, the gaming machine comprising:

a display unit;

a player interface;

a memory; and a processor that executes instructions stored in the memory, wherein execution of the instructions causes the processor to at least:

generate a skill-based game outcome of the skill-based game per one or more player inputs received via the player interface;

cause the display unit to present the skill-based game outcome;

award a first value that is randomly selected based on a first weighted table if the skill-based game outcome is a successful outcome, wherein the first weighted table provides a first return to player; and place a second value into a kitty if the skill-based game outcome is an unsuccessful outcome, wherein the kitty is awarded to at least one of a plurality of competing players, and wherein the second value is randomly selected based on a second weighted table that provides a second return to player that is lower than the first return to player.

2. The gaming machine of claim 1, wherein the second return to player is non-zero.

3. The gaming machine of claim 1, wherein execution of the instructions further causes the processor to provide an overall return to player for the skill-based game such that the overall return to player is at least as great as the second return to player.

4. The gaming machine of claim 1, wherein execution of the instructions further causes the processor to provide an overall return to player for the skill-based game such that the overall return to player is no greater than the first return to player.

5. The gaming machine of claim 1, wherein execution of the instructions further causes the processor to at least award the kitty to a winning player of the plurality of competing players.

6. The gaming machine of claim 5, wherein execution of the instructions further causes the processor to present, via the display unit, a current amount won by each player of the plurality of competing players and a kitty amount to be paid to the winning player of the plurality of competing players.

7. The gaming machine of claim 1, wherein execution of the instructions further causes the processor to award the kitty among remaining players of the plurality of competing players in response to determining, based on the one or more player inputs, that a player forfeited.

8. The gaming machine of claim 1, wherein execution of the instructions further causes the processor to award the kitty among remaining players of the plurality of competing players in response to determining, based on an elapsed time period, that a player forfeited.

9. The gaming machine of claim 1, wherein execution of the instructions further causes the processor, in response to determining that a player has ceased play of the skill-based game to:

pay the player per a current amount won by the player in the skill-based game; and award the kitty among remaining players of the plurality of competing players.

10. The gaming machine of claim 1, wherein execution of the instructions further causes the processor to split the kitty among each player of the plurality of competing players.

11. A method of playing a skill-based game of a gaming machine, the method comprising:

receiving one or more player inputs via a player interface of the gaming machine;

presenting, via a display unit of the gaming machine, a skill-based game outcome per the one or more player inputs received via the player interface;

randomly selecting, with a gaming controller of the gaming machine, a first award value based on a first weighted table in response to the skill-based game outcome being a successful outcome, wherein the first weighted table provides a first, non-zero return to player; and redirecting, with the gaming controller, a second award value to a prize pool in response to the skill-based game outcome being an unsuccessful outcome, wherein the prize pool is awarded in response to a triggering condition, and wherein the second award value is randomly selected based on a second weighted table that provides a second, non-zero return to player.

12. The method of claim 11, wherein the second, non-zero return to player is less than the first, non-zero return to player.

13. The method of claim 11, further comprising providing awards to a plurality of players competing in the skill-based game such that an overall return to player for the skill-based game is no greater than the first, non-zero return to player.

14. The method of claim 11, wherein:

the triggering condition comprises a player of a plurality of competing players winning the skill-based game; and the method further comprises awarding the prize pool to the player of the plurality of competing players who won in the skill-based game.

15. A non-transitory computer readable storage medium comprising instructions, which when executed, cause a processor to:

receive one or more player inputs via a player interface;

cause a presentation of a skill-based game outcome of a skill-based game on a display per the one or more player inputs received via the player interface;

randomly select a first award value based on a first weighted table associated with the skill-based game outcome being a successful outcome, wherein the first weighted table provides a first, non-zero return to player; and allocating a second award value to a prize pool in response to the skill-based game outcome being an unsuccessful outcome, wherein the prize pool is awarded to at least one player in response to a trigger condition, wherein the second award value is randomly selected based on a second weighted table that provides a second, non-zero return to player.

16. The non-transitory computer readable storage medium of claim 15, wherein the instructions further cause the processor to provide awards to a plurality of players competing in the skill-based game such that an overall return to player for the skill-based game is at least as great as the second, non-zero return to player.

17. The non-transitory computer readable storage medium of claim 15, wherein:

the triggering condition is a player of a plurality of competing players winning the skill-based game; and the instructions further cause the processor to award the prize pool to the player of the plurality of competing players who won the skill-based game.

18. The non-transitory computer readable storage medium of claim 15, wherein:

the triggering condition comprises a player forfeiting; and the instructions further cause the processor to award the prize pool among remaining players competing in the skill-based game in response to determining, based on an elapsed time period, that a player forfeited.

19. The non-transitory computer readable storage medium of claim 15, wherein:

the triggering condition comprises a player ceasing play of the skill-based game; and the instructions further cause the processor, in response to determining that the player has ceased play of the skill-based game, to:

cause a payout to the player of a current amount won by the player in the skill-based game; and award the prize pool among remaining players competing in the skill-based game.

20. The non-transitory computer readable storage medium of claim 15, wherein:

the triggering condition comprises the skill-based game ending; and the instructions further cause the processor to split the prize pool among each player competing in the skill-based game in response to the skill-based game ending.

* * * * *